US007134947B2

(12) United States Patent
Stark et al.

(10) Patent No.: US 7,134,947 B2
(45) Date of Patent: Nov. 14, 2006

(54) CHEMICAL MECHANICAL POLISHING SYSTEM

(75) Inventors: David A. Stark, Dallas, TX (US); Christopher Schutte, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 118 days.

(21) Appl. No.: 10/696,623

(22) Filed: Oct. 29, 2003

(65) Prior Publication Data

US 2005/0095963 A1 May 5, 2005

(51) Int. Cl.
*B24B 7/00* (2006.01)
*B24B 1/00* (2006.01)

(52) U.S. Cl. ..... 451/285; 451/287

(58) Field of Classification Search ..... 451/285–290
See application file for complete search history.

(56) References Cited

U.S. PATENT DOCUMENTS 6,036,586 A 3/2000 Ward ..... 451/287
6,220,942 B1 * 4/2001 Tolles et al. ..... 451/65
6,299,515 B1 * 10/2001 Beardsley et al. ..... 451/285
6,398,905 B1 * 6/2002 Ward ..... 156/345.12
6,422,921 B1 * 7/2002 Ettinger ..... 451/41
6,607,429 B1 * 8/2003 Damgaard ..... 451/442
6,663,472 B1 * 12/2003 Lim et al. ..... 451/57

* cited by examiner

*Primary Examiner*—M. Rachuba
(74) *Attorney, Agent, or Firm*—Peter K. McLarty; W. James Brady, III; Frederick J. Telecky, Jr.

(57) ABSTRACT

According to one embodiment of the invention, a chemical mechanical polishing system includes a platen having a first surface adapted to couple a polishing pad thereto. The first surface includes a generally circular center portion and an annular portion surrounding the generally circular center portion. The generally circular center portion encloses an area and has an attachment surface area that is less than the area enclosed by the generally circular center portion. The attachment surface area is adapted to couple an inner portion of the polishing pad to the platen.

According to one embodiment of the invention, a chemical mechanical polishing system includes a platen having a first surface coupling a polishing pad thereto. The first surface includes a generally circular center portion and an annular portion surrounding the generally circular center portion. The generally circular center portion encloses an area and has an attachment surface area that is less than the area enclosed by the generally circular center portion. The attachment surface area is coupling an inner portion of the polishing pad to the platen.

6 Claims, 2 Drawing Sheets

CHEMICAL MECHANICAL POLISHING SYSTEM

TECHNICAL FIELD OF THE INVENTION

The present invention relates generally to semiconductor wafer processing and, more particularly, to a chemical mechanical polishing ("CMP") system.

BACKGROUND OF THE INVENTION

Chemical mechanical polishing ("CMP") is a semiconductor wafer planarizing and/or polishing procedure widely used in the fabrication of semiconductor wafers. As the name implies, there are two components to the process: chemical and mechanical polishing. Chemical polishing involves the introduction of chemicals that dissolve imperfections and impurities present upon the wafer. Mechanical polishing involves rotating the wafer upon an abrasive "polishing pad" in order to planarize the wafer. Generally, the wafers are mounted upside down on a wafer carrier and rotated above a polishing pad sitting on a platen. The platen is also rotated. Typically, a slurry containing both chemicals and abrasives is introduced upon the pad. The more defect-free the pad is, the less defects that are imparted to the wafer and the longer the pad lasts.

One problem that may occur during the course of many CMP cycles is delamination of the platen coatings around the edge of the platen. This may cause the pad to adhere poorly to the edge and allow the pad to peel up at the edges, which creates a hazard for the wafers.

Another problem is that replacing a pad is not as easy as it sounds since the forces imparted to the pad during the CMP process causes the pad to adhere to the platen with more strength than initially existed when the pad was adhesively coupled to the platen. This may lead to wasted time in removing the pad as well as exacerbating the delamination problem noted above.

SUMMARY OF THE INVENTION

According to one embodiment of the invention, a chemical mechanical polishing system includes a platen having a first surface coupling a polishing pad thereto. The first surface includes a generally circular center portion and an annular portion surrounding the generally circular center portion. The generally circular center portion encloses an area and has an attachment surface area that is less than the area enclosed by the generally circular center portion. The attachment surface area is coupling an inner portion of the polishing pad to the platen.

According to another embodiment of the invention, a chemical mechanical polishing system includes a platen having a first surface that includes a generally circular center portion and an annular portion surrounding the generally circular center portion. The generally circular center portion has a first coating disposed outwardly therefrom, which has a low surface wetting coefficient. The annular portion has a second coating disposed outwardly therefrom, which has a high surface wetting coefficient.

Embodiments of the invention provide a number of technical advantages. Embodiments of the invention may include all, some, or none of these advantages. Reducing defects in semiconductor wafers during a chemical mechanical polishing ("CMP") process greatly improves yield. In one embodiment, a high bond strength is maintained at the perimeter of the platen to prevent the polishing pad from lifting at the edges, which greatly reduces the hazard for the wafers. In addition, the amount of force required to peel back the polishing pad across the center of the platen for replacement is reduced. This speeds up the replacement time as well as reducing the physical exertion required to remove the pad.

Other technical advantages are readily apparent to one skilled in the art from the following figures, descriptions, and claims.

BRIEF DESCRIPTION OF THE DRAWINGS

For a more complete understanding of the present invention and its advantages, reference is now made to the following descriptions, taken in conjunction with the accompanying drawings, in which.

DETAILED DESCRIPTION OF EXAMPLE EMBODIMENTS OF THE INVENTION

Example embodiments of the present invention and their advantages are best understood by referring now to FIGS. 1 through 3B of the drawings, in which like numerals refer to like parts.

Figure 1:
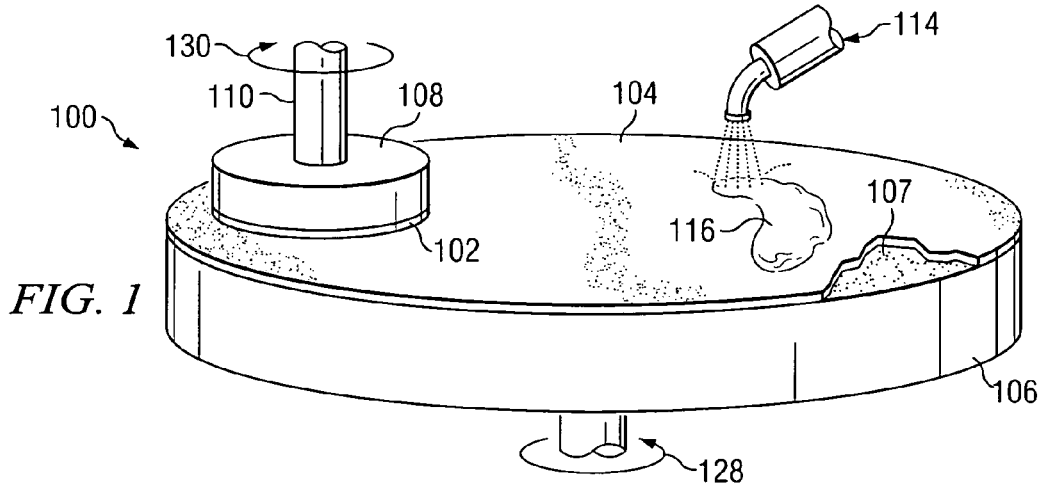
FIG. 1 is a perspective view of a chemical mechanical polishing ("CMP") system in accordance with one embodiment of the present invention.

FIG. 1 is a perspective view of a chemical mechanical polishing ("CMP") system 100 in accordance with one embodiment of the present invention. Generally, CMP system 100 functions to polish and/or planarize one or more semiconductor wafers 102 during the processing of semiconductor wafers 102. One example of CMP system 100 is the Mirra Mesa CMP machine manufactured by Applied Materials®; however, other suitable CMP systems may be utilized within the teachings of the present invention. The type of CMP system, along with the size, shape, and configuration of various components illustrated may be varied significantly within the teachings of the present invention. In the illustrated embodiment, CMP system 100 includes a polishing pad 104 coupled to a platen 106, a wafer carrier 108 having a spindle 110 from manipulating wafer 102, and a slurry delivery system 114 for delivering a liquid slurry 116 to a top surface of polishing pad 104.

Platen 106, which may be formed from any suitable material, such as aluminum or stainless steel, and polishing pad 104 are configured to rotate during the CMP process, as illustrated by arrow 128. In addition, wafer carrier 108 through spindle 110 facilitates the rotation of wafer 102, as denoted by arrow 130, typically in a direction opposite that of platen 106 and polishing pad 104. Accordingly, when wafer 102 engages polishing pad 104 while both are rotating, wafer 102 is polished and/or planarized to provide a clean, flat surface on wafer 102.

Slurry delivery system 114 provides, in any suitable manner, liquid slurry 116 to polishing pad 104 to enhance the CMP process. Liquid slurry 116 may include acids and/or other suitable chemicals that interact with wafer 102 in order to loosen, or at least partially remove, metals, oxidation, and other impurities present upon wafer 102.

Liquid slurry 116 may also include small particles of glass and/or other suitable abrasive materials that grind wafer 102 during the CMP process.

One problem that may occur during the course of many CMP cycles is delamination of a coating 107 on platen 106 around the outer edge of platen 106. This may cause polishing pad 104 to adhere poorly to the outer edge and allow polishing pad 104 to "peel up" at the edges, which may create a hazard for wafer 102. Another problem that may occur is during the replacement of polishing pad 104. Forces imparted during the CMP process may cause polishing pad 104 to adhere to platen 106 with more strength than initially existed when polishing pad 104 was adhesively coupled to platen 106. This may lead to wasted time in replacing polishing pad 104, as well as possibly leading to injury for the personnel that is replacing polishing pad 104. Some embodiments of the present invention address these problems, and others, as described below in conjunction with FIGS. 2A–3B.

Figure 2A:
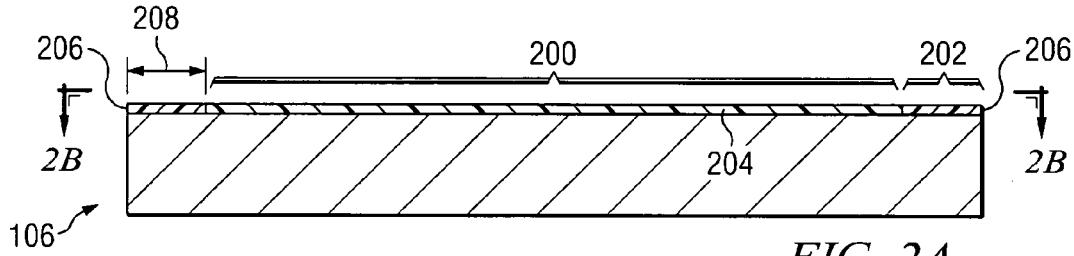
FIG. 2A is a cross-sectional view of a platen in accordance with one embodiment of the present invention.
Figure 2B:
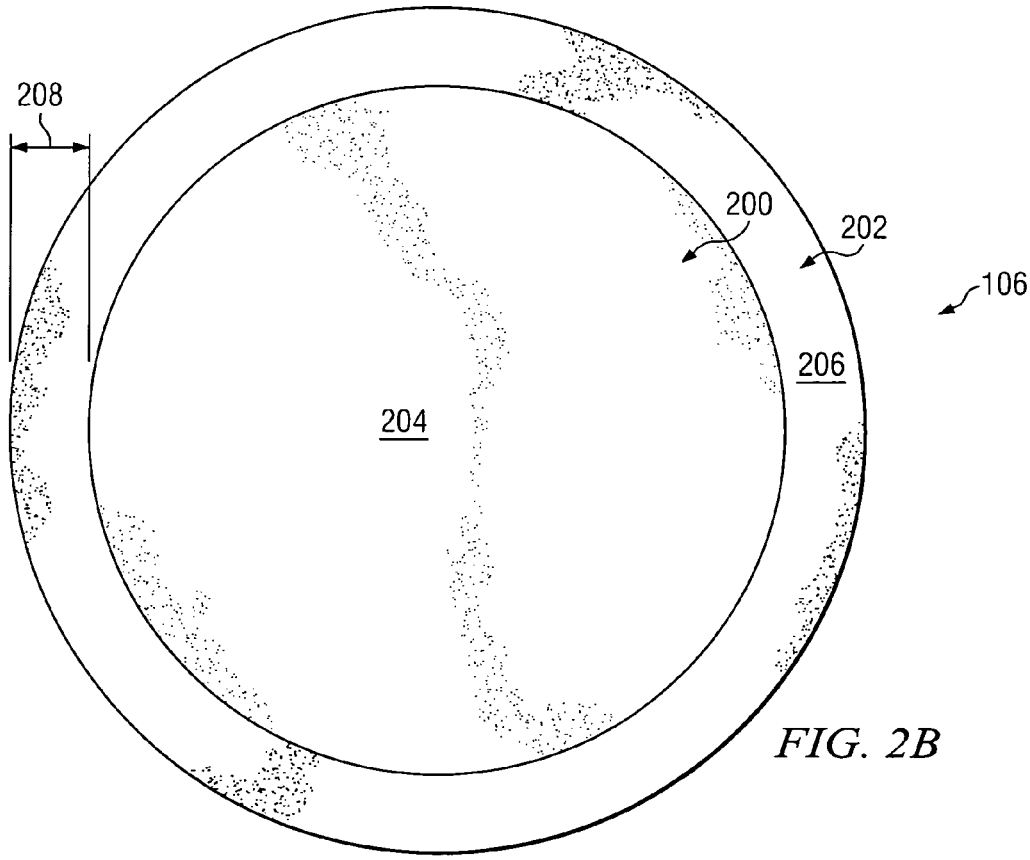
FIG. 2B is a plan view of the platen of FIG. 2A.

FIGS. 2A and 2B are cross-sectional and plan views, respectively, of platen 106 in accordance with the teachings of one embodiment of the invention. In the illustrated embodiment, platen 106 includes a generally circular center portion 200 and an annular portion 202 surrounding center portion 200. Center portion 200 includes a coating 204 disposed outwardly therefrom and annular portion 202 includes a coating 206 disposed outwardly therefrom. According to the teachings of one embodiment of the invention, coating 204 has a low surface wetting coefficient, while coating 206 has a high surface wetting coefficient. As one example, the surface wetting coefficient of coating 204 may be approximately one-half of the surface wetting coefficient of coating 206. This facilitates easier removal of polishing pad 104 when it needs to be replaced because coating 204 associated with center portion 200 results in less bond strength between coating 204 and polishing pad 104 than in prior CMP systems. Although a relatively high bond strength still exists between coating 206 and an outer annular portion of polishing pad 104, having a relatively low bond strength between coating 204 and a center portion of polishing pad 104 significantly reduces the time and effort to remove polishing pad 104 from platen 106. One reason that coating 206 includes a high surface wetting coefficient is so that polishing pad 104 may adhere to an outer annular portion of platen 106 to prevent polishing pad 104 from peeling up around its perimeter.

Coatings 204 and 206 may have any suitable thickness; however, in one embodiment, the thickness of coatings 204 and 206 are between 10 mils and approximately 20 mils. Both coating 204 and coating 206 may be coupled to platen 106 in any suitable manner and may be formed from any suitable material. In one embodiment, coatings 204 and 206 are each formed from a fluoropolymer. Other suitable materials may also be utilized for coatings 204 and 206, such as inert polymers or non-polymeric coatings or compounds. In a particular embodiment of the invention, coating 204 is formed from Teflon® and coating 206 is formed from Halar®. In another particular embodiment where aluminum is utilized for platen 106, coating 204 may also be formed from a Tufram® coating by General Magnaplate. In one embodiment, a width 208 of annular portion 202 is between approximately ½ inch and approximately 1 inch. However, other suitable widths may be utilized for width 208.

Because platens in prior CMP systems have had delamination problems of the anodized coating around its edge, which caused the lifting of polishing pads around the edge, it is desirable for the material used for coating 206 to be chemically resistant to liquid slurry 116 to avoid any delamination of coating 206. This is why, in one embodiment, Halar® may be utilized for coating 206.

Figure 3A:
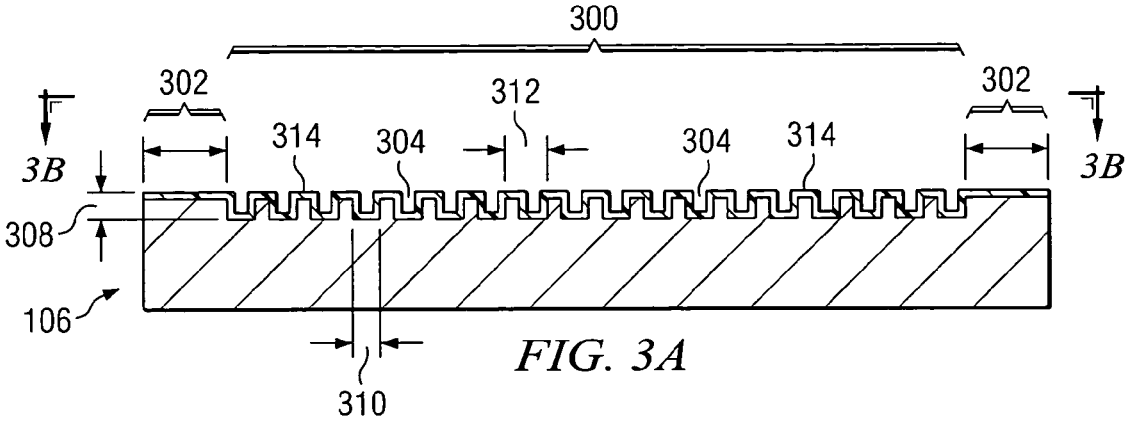
FIG. 3A is a cross-sectional view of a platen in accordance with another embodiment of the present invention.
Figure 3B:
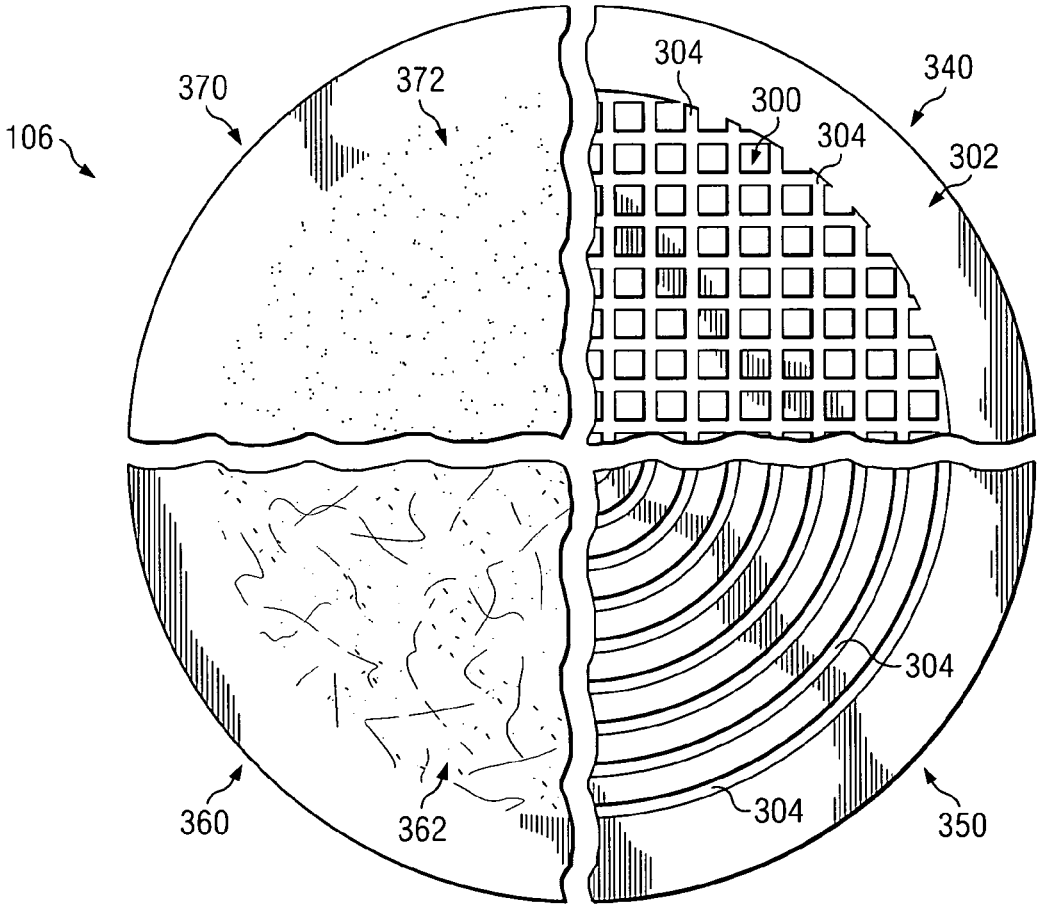
FIG. 3B is a plan view of the platen of FIG. 3A.

FIGS. 3A and 3B are cross-sectional and plan views, respectively, of platen 106 in accordance with another embodiment of the present invention. In this embodiment, platen 106 includes a generally circular center portion 300 and an annular portion 302 surrounding center portion 300, similar to the embodiment illustrated in FIGS. 2A–2B. However, in the embodiment illustrated in FIGS. 3A and 3B, center portion 300 includes an attachment surface area available for coupling polishing pad 104 to platen 106 that is less than the total area enclosed by center portion 300. This reduces the bonding strength between platen 106 and polishing pad 104 because of the reduced surface area available for coupling polishing pad 104 to platen 106 within center portion 300.

In one embodiment, the attachment surface area of center portion 300 that is available for coupling polishing pad 104 to platen 106 is between approximately 30 percent and approximately 70 percent of the total area enclosed by center portion 300. In a particular embodiment, the attachment surface area is approximately 50 percent of the area enclosed. This reduction in area may be facilitated by texturing a top surface of platen 106 in any suitable manner.

For example, referring to FIG. 3A, a plurality of grooves 304 may be formed in center portion 300 of platen 106. A plan view of grooves 304 is illustrated in FIG. 3B by reference numerals 340 or 350 depending on the configuration of grooves 304. As indicated by reference numeral 340, a configuration of grooves 304 may take the form of a hatched configuration, or as indicated by reference numeral 350 may take the form of concentric circles. Other suitable configurations for grooves 304 are contemplated by the present invention, such as a parallel configuration, a criss-cross configuration, a spiral configuration, and a random configuration. In an embodiment where grooves 304 are utilized to reduce the surface area available for coupling polishing pad 104 to platen 106, groove 304 may have any suitable depth, any suitable width, and any suitable center line spacing. For example, in one embodiment, a depth 308 of grooves 304 is approximately 15–20 mils, a width 310 of grooves 304 is approximately 1 millimeter, and a center line spacing 312 between grooves 304 is approximately 1 millimeter. Other suitable configurations for grooves 304 instead of square grooves are contemplated by the present invention, such as U-grooves and V-grooves.

Referring to FIG. 3B, various texturing of center portion 300 is illustrated. For example, referring to reference numeral 360, center portion 300 may be defined by a brushed surface 362, which is formed on the top surface of platen 106 using any suitable brushing process. As illustrated by reference numeral 370, center portion 300 may be defined by a dimpled surface 372 formed in the top surface of platen 106 using any suitable process. Other suitable texturing processes to reduce the attachment surface area available for coupling polishing pad 104 to platen 106 is contemplated by the present invention.

Referring back to FIG. 3A, a coating 314 may be disposed outwardly from the top surface of platen 106 in such a manner that all of the exposed surfaces of platen 106 and grooves 304 are covered with coating 314. Coating 314 may be any suitable coating, such as an anodized coating or a suitable fluoropolymer coating that is formed on the top surface of platen 106 in any suitable manner. In a particular embodiment of the invention, the teachings of the invention as illustrated in FIGS. 2A and 2B, in which center portion 200 includes coating 204 having a lower surface wetting coefficient than coating 206 of annular portion 202, may be applied to the teachings of the invention illustrated in FIGS. 3A and 3B, in which the attachment surface area available for coupling polishing pad 104 to platen 106 is reduced in center portion 300. Accordingly, in one embodiment, a Teflon® or other suitable fluoropolymer may comprise a portion of coating 314 within center portion 300 and a Halar® or other suitable fluoropolymer having a high surface wetting coefficient may comprise a portion of coating 314 around annular portion 302. In this manner, the advantages of both approaches noted above may be combined.

Thus, wafer manufacturers may benefit from utilization of platen 106 according to the teachings of various embodiments of the present invention by having a center portion of platen 106 that does not bond to the polishing pad with as much strength as in prior CMP systems. Consequently, it will take less force to peel back the polishing pad during replacement of the polishing pad, yet still have high bond strength between the polishing pad and platen so that any lifting at the edges substantially reduced or eliminated. This will not only increase the yield of wafers, but also speed up the replacement time for polishing pads as well as reducing physical exertion and risk of potential injury during removal and replacement of polishing pads.

Although embodiments of the invention and their advantages are described in detail, a person skilled in the art could make various alterations, additions, and omissions without departing from the spirit and scope of the present invention as defined by the appended claims.

What is claimed is:

1. A chemical mechanical polishing system, comprising:

a platen for coupling a polishing pad thereto, the platen having a first surface comprising a generally circular center portion and an annular portion surrounding the generally circular center portion;

the generally circular center portion enclosing an area and having a first attachment surface area that is between approximately 30% and 70% of the area enclosed by the generally circular center portion, the first attachment surface area adapted to couple an inner portion of the polishing pad to the platen;

the generally circular center portion having a first fluoropolymer coating disposed outwardly therefrom, the first fluoropolymer coating having a low surface wetting coefficient;

the annular portion having a second attachment surface area adapted to couple an outer portion of the polishing pad to the platen, the annular portion having a width between approximately one-half inch and approximately one inch;

the annular portion having a second fluoropolymer coating disposed outwardly therefrom, the second fluoropolymer coating having a high surface wetting coefficient; and wherein the first and second fluoropolymer coatings each have a thickness of between approximately ten mils and approximately twenty mils.

2. The system of claim 1, wherein the generally circular center portion is defined by a plurality of grooves formed in the first surface, a configuration of the grooves selected from the group consisting of parallel, hatched, criss-crossed, concentric, spiral, and random.

3. The system of claim 1, wherein a depth of grooves is approximately fifteen to twenty mils, a width of grooves is approximately one millimeter, and a centerline spacing between grooves is approximately one millimeter.

4. The system of claim 1, wherein the generally circular center portion is defined by a textured surface selected from the group consisting of a dimpled surface and a brushed surface.

5. The system of claim 1, wherein the first fluoropolymer coating is chemically resistant to the liquid slurry.

6. The system of claim 1, wherein the second fluoropolymer coating is chemically resistant to the liquid slurry.

* * * * *